US007244162B2

(12) United States Patent
Tsai et al.

(10) Patent No.: US 7,244,162 B2
(45) Date of Patent: Jul. 17, 2007

(54) MODEL STICK PLANE

(76) Inventors: Yu-Chi Tsai, P.O. Box 487, Chang-Hua City 500 (TW); Ming-Hung Hsieh, P.O. Box 487, Chang-Hua City 500 (TW)

( * ) Notice: Subject to any disclaimer, the term of this patent is extended or adjusted under 35 U.S.C. 154(b) by 2 days.

(21) Appl. No.: 11/199,851

(22) Filed: Aug. 10, 2005

(65) Prior Publication Data

US 2006/0178078 A1 Aug. 10, 2006

(30) Foreign Application Priority Data

Feb. 4, 2005 (TW) ..... 94202089 U

(51) Int. Cl.
*A63H 27/18* (2006.01)
*A63H 27/22* (2006.01)

(52) U.S. Cl. ..... 446/59

(58) Field of Classification Search ..... 446/34, 446/57, 58, 59, 60
See application file for complete search history.

(56) References Cited

U.S. PATENT DOCUMENTS 2,543,516 A * 2/1951 Walker ..... 446/59
3,174,252 A * 3/1965 Sunray ..... 446/59
3,952,448 A * 4/1976 Kabchef ..... 446/59
4,280,298 A * 7/1981 Kulzer ..... 446/59
4,842,222 A * 6/1989 Baird ..... 244/155 R
5,525,087 A * 6/1996 Chin-Lin ..... 446/59

* cited by examiner

*Primary Examiner*—John A. Ricci

(57) ABSTRACT

The present invention relates to a stick fuselage of a model aircraft that also combines an aircraft nose and a main wing brace. The stick fuselage adopts a transverse H-beam as a main body. Two sides of the main body have continuously annular bodies as reinforcement structures. The aircraft nose is connected to a head of the stick fuselage, and has a concave spherical surface and a spherical convex to form a spherical pairing. The middle of the stick fuselage has a fuselage sleeve. Two ends of the fuselage sleeve are connected to a hollow ring respectively to form the main wing brace. The main wing brace uses a hollow double ring as a basic configuration for division assembly and accumulation assembly so as to make a monoplane, a biplane and a triplane.

9 Claims, 8 Drawing Sheets

MODEL STICK PLANE

FIELD OF THE INVENTION

The present invention is related to a stick fuselage of model aircraft, and more particularly, to hollow rings of a main wing brace that combine with down thrust to overcome structural variation and differences in angle of incidence of various types of model aircrafts.

BACKGROUND OF THE INVENTION

Some model aircrafts usually use rubber bands as a power source. In a stick fuselage of a model aircraft, the configuration of the connection provided for a propeller shaft to be connected therein may be constant, and a connection hole may not be adjusted. Herein a down thrust formed by the horizontal line of the stick fuselage and an axis of the propeller shaft may not have any fine adjustment after assembling. But the degree of the down thrust also relates to whether or not the lateral deflection force generated by rotation torque of the propeller can be resisted completely when the model aircraft is propelled by power. Therefore, once the model aircraft is made, the axis of the connection hole of the stick fuselage may suffer the small deflections due to irresistible or man-made reasons. Then the model aircraft may lose its stability while in climbing attitude, and the defect rate may also be increased.

Moreover, the connection structure between the conventional stick fuselage and wings directly disposes insertion holes on predetermined sections of the fuselage to position and insert the wings. The drawbacks of the structure includes that the connections between the fuselage and the wings may be loosened, and the wings may not be kept at a level, and the lengths of the wings extended from two sides of the fuselage may be asymmetric to easily lose the balance. Furthermore, the wings may easily suffer aerodynamic drag in flying and the wings may be come off the fuselage. The connection structure between the wings and the fuselage may be merely applied to a monoplane, a biplane or a triplane without any relation to each other. The manufacture cost may also be increased.

SUMMARY OF THE INVENTION

A primary object of the present invention is to provide a stick fuselage of a model aircraft. The stick fuselage also combines an aircraft nose and a main wing brace to form the model aircraft. The aircraft nose is a structure that is assembled to the front of the stick fuselage to install a power system. The shape of the aircraft nose may be different based on different power systems. The main wing brace uses a pair of hollow rings disposed to center of gravity position of the stick fuselage to be a main structure for providing the stick fuselage to connect with the main wing. The stick fuselage, the aircraft nose and the main wing brace have the following features:

1. The main structure of the stick fuselage is a transverse H-beam. An interval between two sides of the transverse H-beam has continuously annular bodies made by integrated molding as reinforcement structures. The continuously annular bodies are interlaced to enhance bending and twist resistances.
2. The aircraft nose has a spherical pairing that is used to adjust the direction of a power shaft.
3. The main wing brace utilizes a hollow double ring as basic configuration for division assembly and accumulation assembly.

The main wing brace is used to fasten and assemble the main wing. The types of the main wing brace can be designed for a monoplane, a biplane and a triplane. Those main wing braces can be assembled to the same stick fuselage. Moreover, the main wing brace can be an 8-shaped that increases the entire benefit. It may help the flight balance of the model aircraft. The relative positions can be fine adjusted when the main wing brace is assembled to the stick fuselage. Furthermore, the connection between members can be secured absolutely.

DETAILED DESCRIPTION OF THE PREFERRED EMBODIMENT

Figure 1:
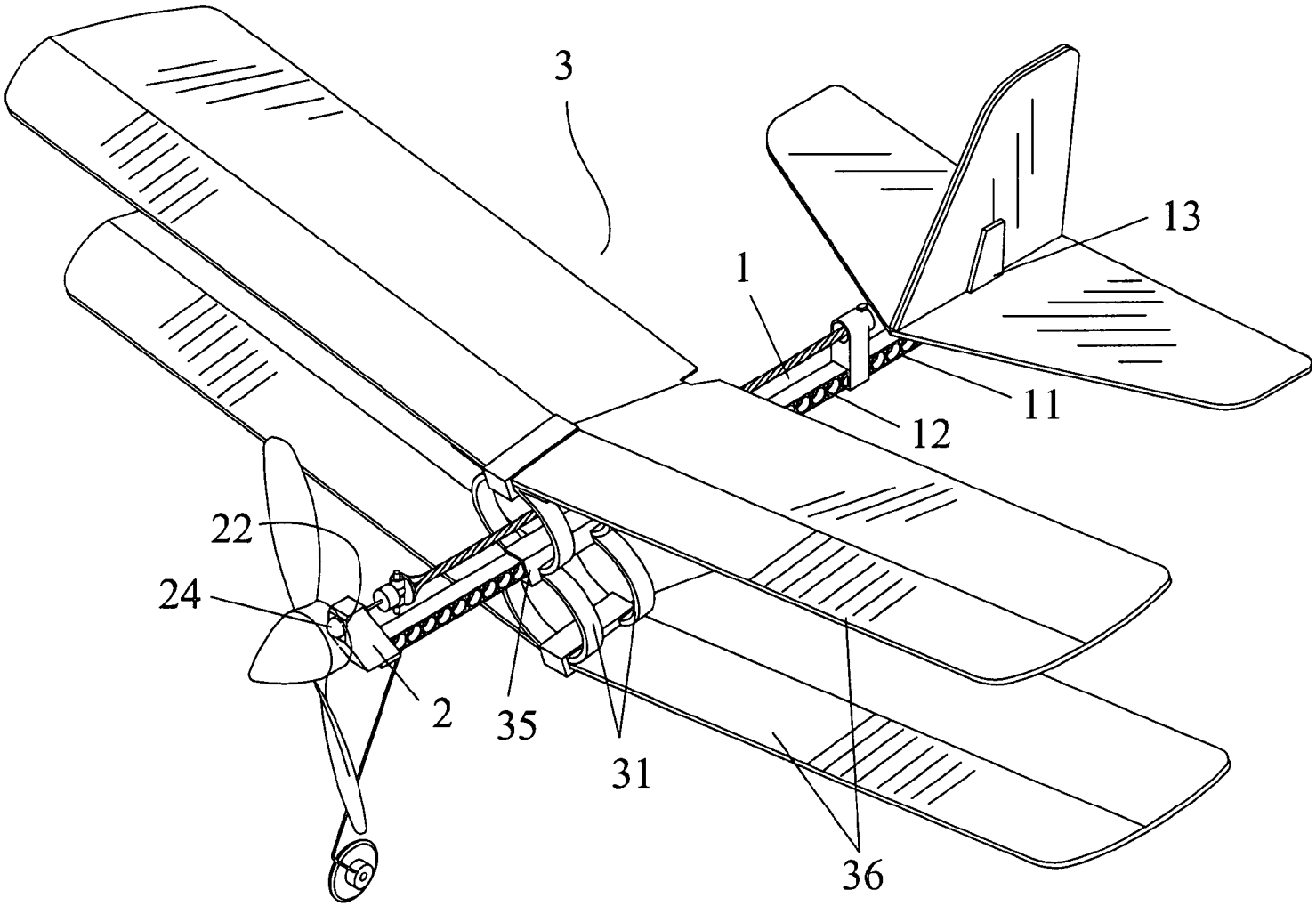
FIG. 1 is a side view illustrating a stick fuselage of a model aircraft applied to a biplane according to an embodiment of the present invention.

Referring to FIG. 1 for a side view of a stick fuselage of a model aircraft of the present invention is illustrated. Herein the embodiment takes a biplane as an example that includes the stick fuselage 1, an aircraft nose 2 and a main wing brace 3 (Please refer to FIG. 7 for these configurations).

The main body 11 of the stick fuselage 1 is a transverse H-beam. The two sides of the main body 11 have continuously annular bodies 12 as reinforcement structures (explanation shown in FIG. 2). The aircraft nose 2 is connected to the head of the stick fuselage 2, wherein the aircraft nose 2 is composed of a concave spherical surface 22 and a spherical bearing 24 so as to form a spherical pairing (explanation shown in FIG. 3). The main wing brace 3 uses two hollow double rings 31 for assembling two ends of a fuselage sleeve 35 (explanation shown in FIG. 6) so as to be disposed at the middle of the stick fuselage 1.

As shown in FIG. 1, two main wings 36 are combined to a lower and upper portion of the main wing brace 3. A tail combination 13 is disposed to the rear of the stick fuselage 1.

Figure 2:
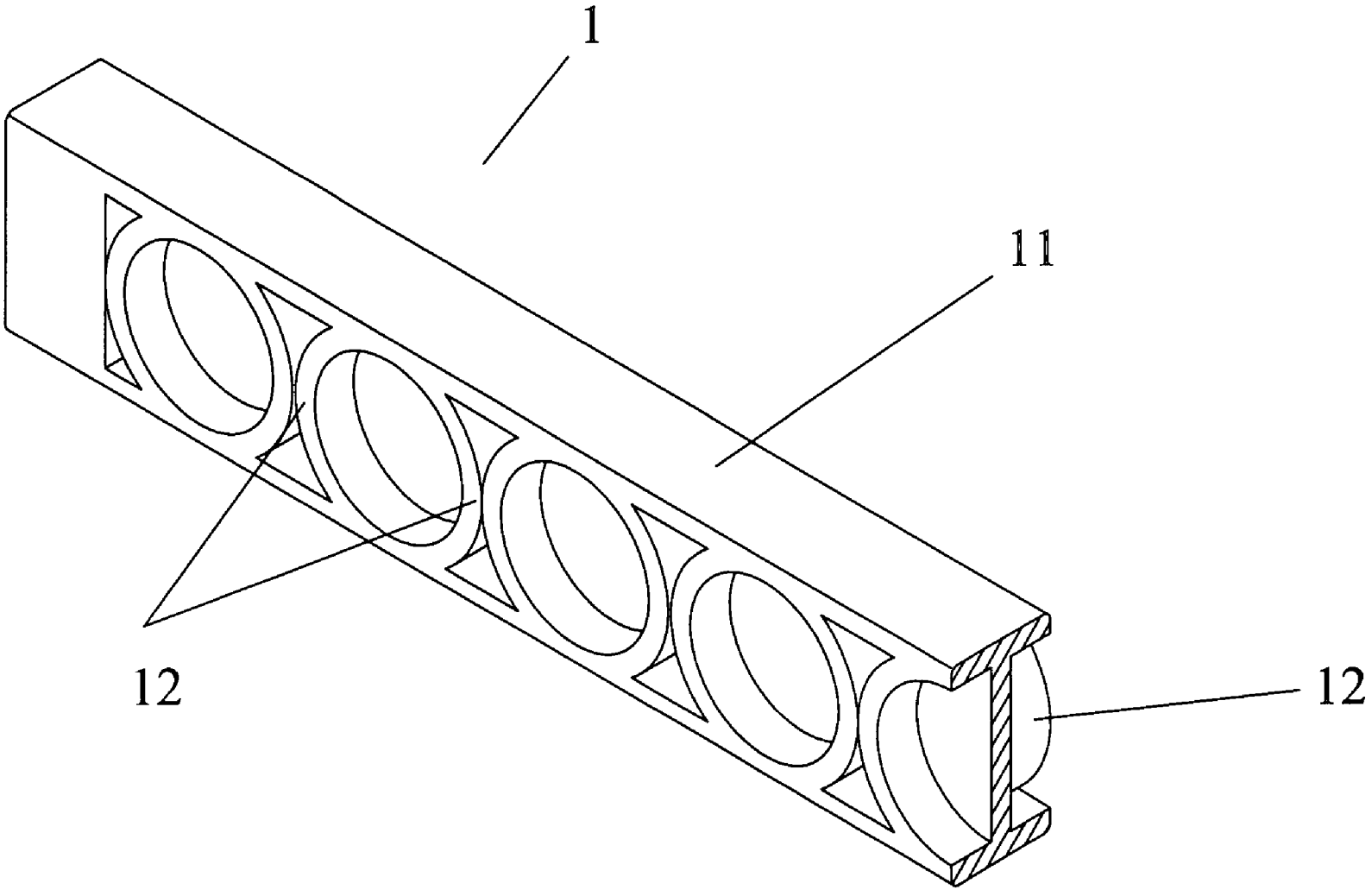
FIG. 2 is a side view illustrating a stick fuselage composed of a transverse H-beam and continuously annular bodies of the present invention.

FIG. 2 is a side view for a stick fuselage of the, present invention. The two sides of the main body 11 of the stick fuselage 1 have continuously annular bodies 12 as reinforcement structures. Dotted lines shown in the figure are that the continuously annular bodies 12 are interlaced with each other so that the structural strength of the stick fuselage 1 is increased to support the twist requirement of a rubber.

Figure 3:
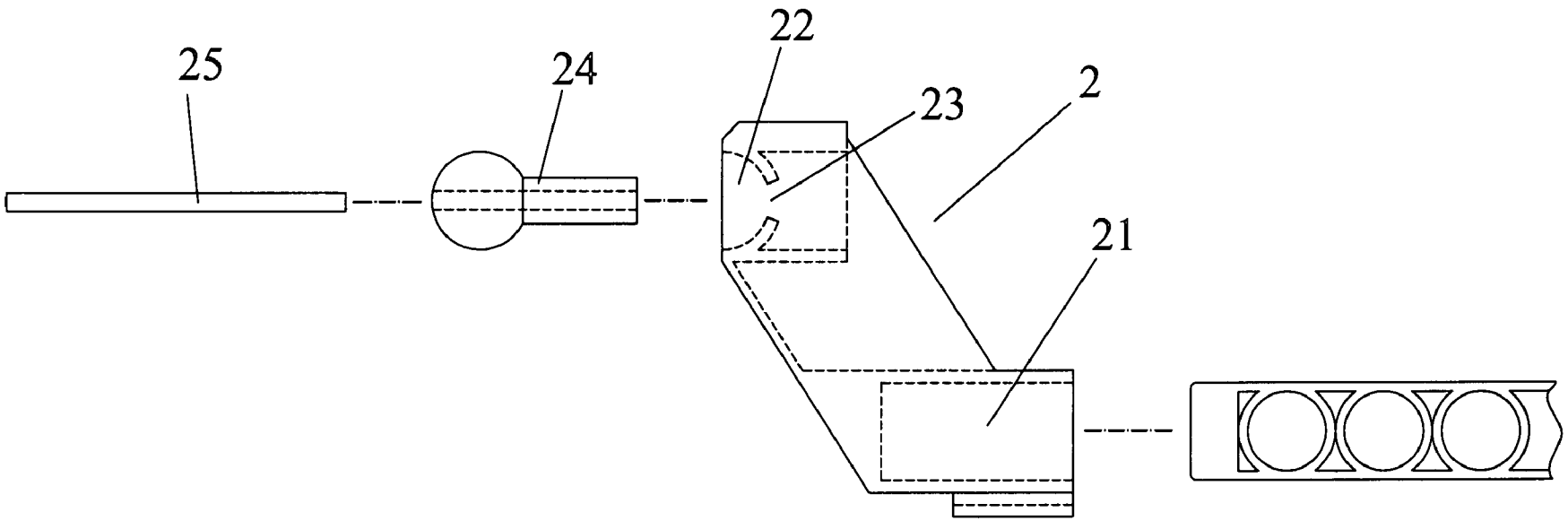
FIG. 3 is a side view illustrating a rubber band motor applied to an aircraft nose according to an embodiment of the present invention.

FIG. 3 is a side view for an aircraft nose. The rear of the aircraft nose 2 has a square hole as a fuselage socket 21 so that the front of the stick fuselage 1 can insert into the socket 21. The front of the aircraft nose 2 has a half-spherical cavity 22 that forms a spherical pairing together with a spherical bearing 24 to allow free adjustment of direction. The spherical bearing 24 is composed of a spherical tip and a tube tail that passes through the through hole 23 of the bottom of the half-spherical cavity 22 to take the rotation motion of a power shaft 25. The spherical pairing composed of the half-spherical cavity 22 and the spherical bearing 24 could adjust the thrust line for various model aircrafts. The spherical bearing 24 and the tube tail can be glued to the aircraft nose 2. The embodiment shown in FIG. 3 is merely applied to a rubber band power.

Figure 4:
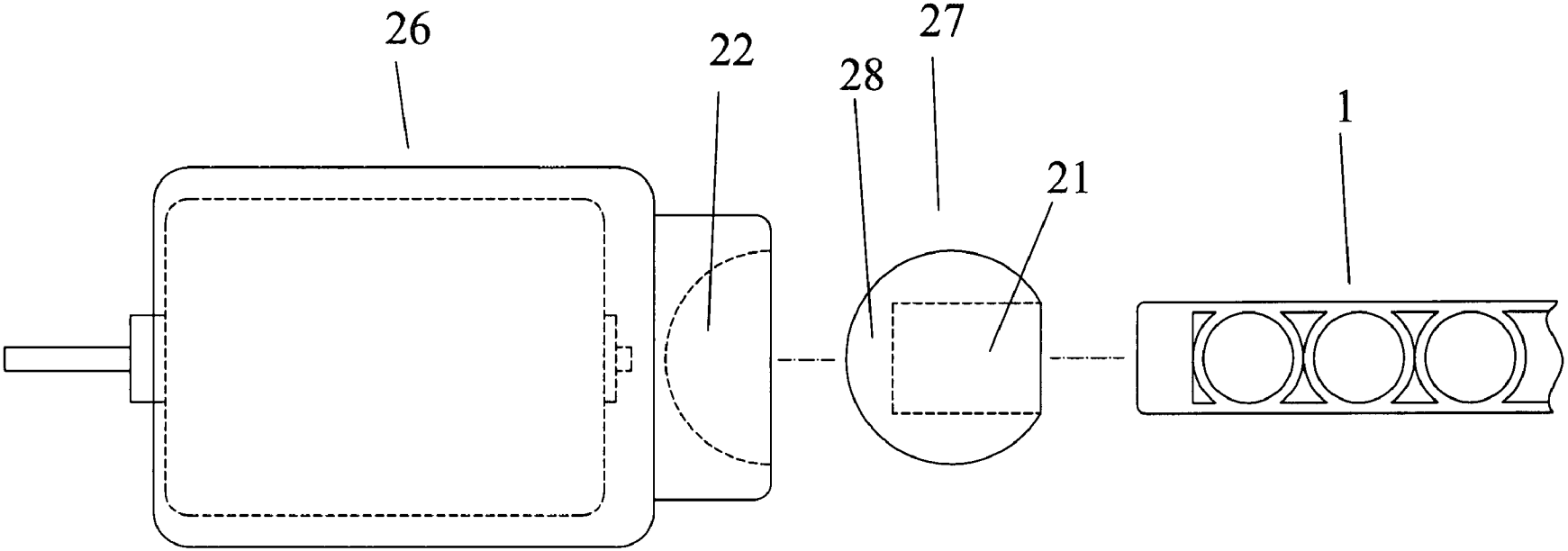
FIG. 4 is a schematic diagram illustrating an electric motor applied to an aircraft nose according to an embodiment of the present invention.

Referring to FIG. 4, a schematic diagram shows an electric motor disposed to an aircraft nose according to another embodiment of the present invention. The aircraft nose is changed to a motor box 26. The rear of the motor box 26 has a half-spherical cavity 22. The half-spherical cavity 22 and a half-spherical convex 28 of a spherical connector 27 form a spherical pairing. The stick fuselage 1 is inserted into the fuselage socket 21 of the spherical connector 27. Herein the embodiment uses the motor box 26 and the spherical connector 27 could adjust the thrust line for various model aircrafts as shown in FIG. 3. Meanwhile, the half-spherical cavity 22 and the spherical connector 28 are glued together for positioning.

Figure 5:
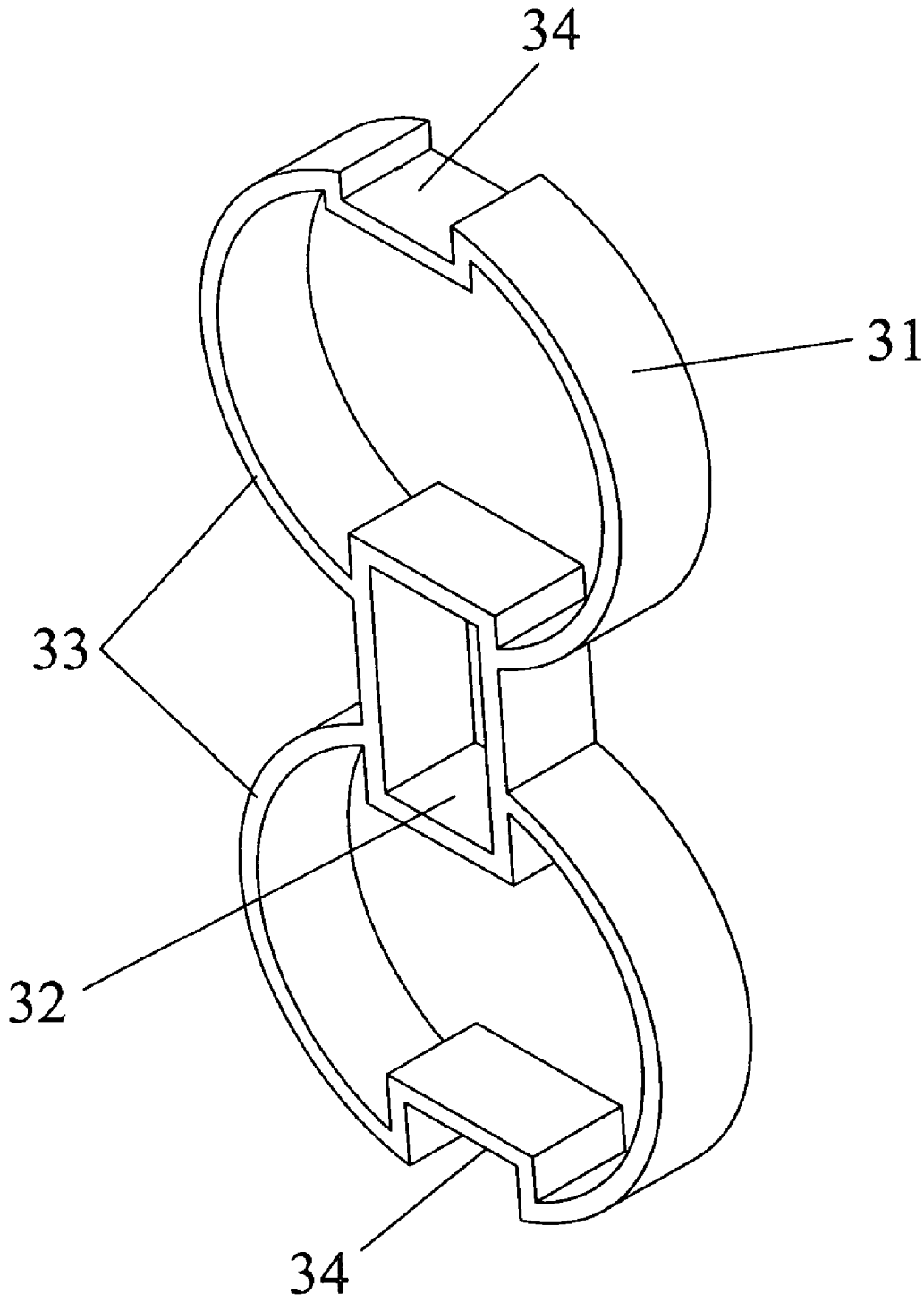
FIG. 5 is a front and side view illustrating double rings of a main wing brace.

FIG. 5 is a front view and side view for illustrating a critical member of a main wing brace. A hollow double ring 31 is formed by two single hollow rings 33 connected with each other via a rectangular brace member 32. Upper and lower ends of the two hollow double rings have notches 34 respectively to assemble two main wings 36 (refer to FIG. 6). The side view as shown in the embodiment is that the hollow double ring 31 is arranged as the inclination for incorporating stagger and wing gap of main wings.

The hollow double ring 31 is combined by integrating two single hollow rings 33 to expand structural benefits with few materials. Therefore, the main wings can be supported, and the angle of incidence can be stabilized. Furthermore, the hollow double rings can be taken as channels for a rubber band. The hollow double ring of the main wing brace is a hollow annular ring, a hollow ellipse, a hollow square ring or a hollow polygon.

Figure 6:
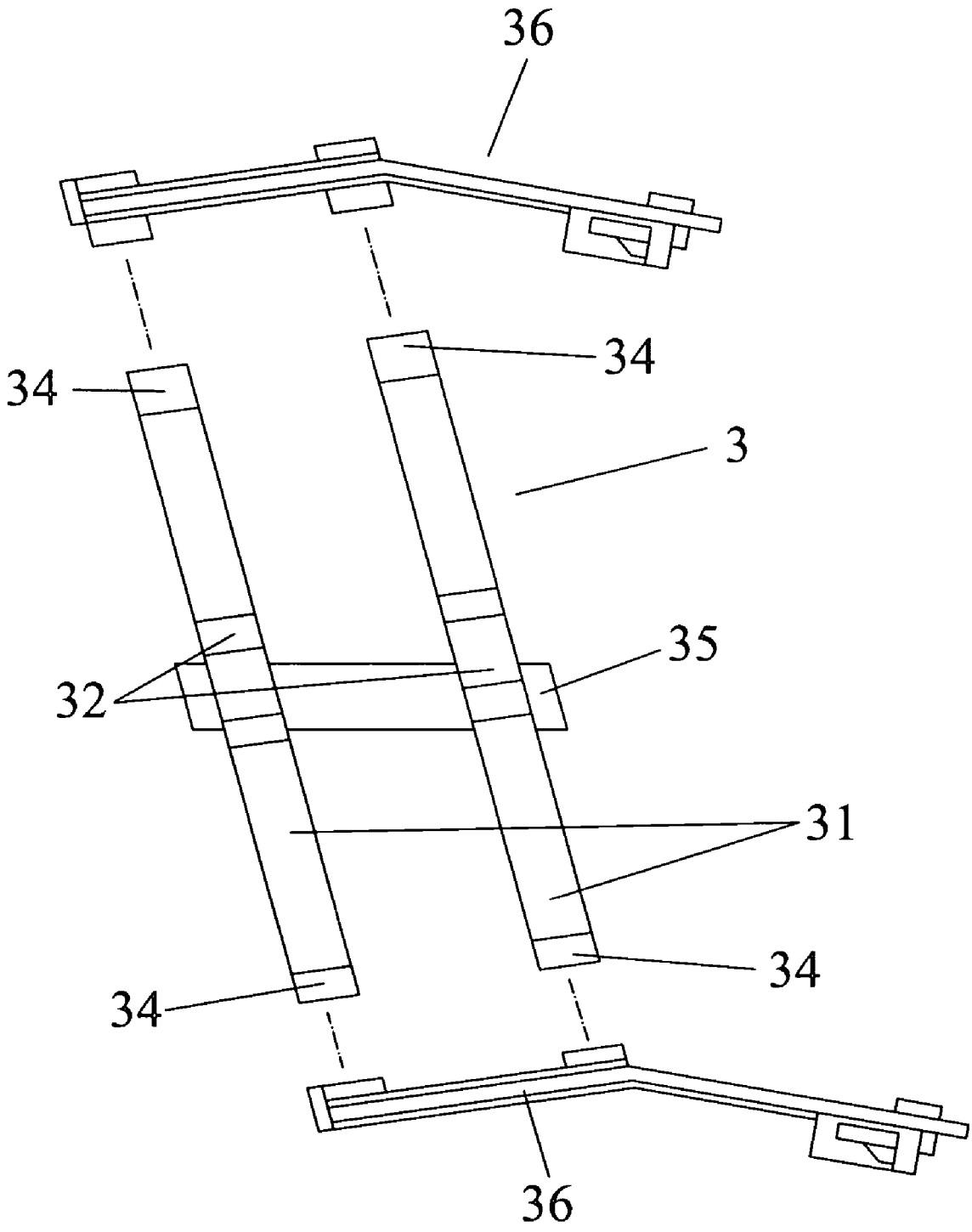
FIG. 6 is a cross-sectional drawing illustrating a main wing brace applied to a biplane of the present invention.

FIG. 6 is a side view for a main wing brace of the present invention. The main wing brace 3 is composed of a fuselage sleeve 35 and two hollow double rings 31. The fuselage sleeve 35 is a tube-shaped for incorporating the stick fuselage. The brace members 32 connected to the two hollow double rings 31 are assembled to two ends of the tube. The brace members 32 are rectangles as shown in FIG. 5. The width of the rectangle can match with the fuselage sleeve 35. Its height can preset a space for providing the two hollow double rings 31 at different levels while connecting with each other to form the angle of incidence for the main wings. The upper and lower ends of the two hollow double rings 31 have the notches 34 for assembling upper and lower main wings, thereby providing a biplane as shown in FIG. 1.

Figure 7:
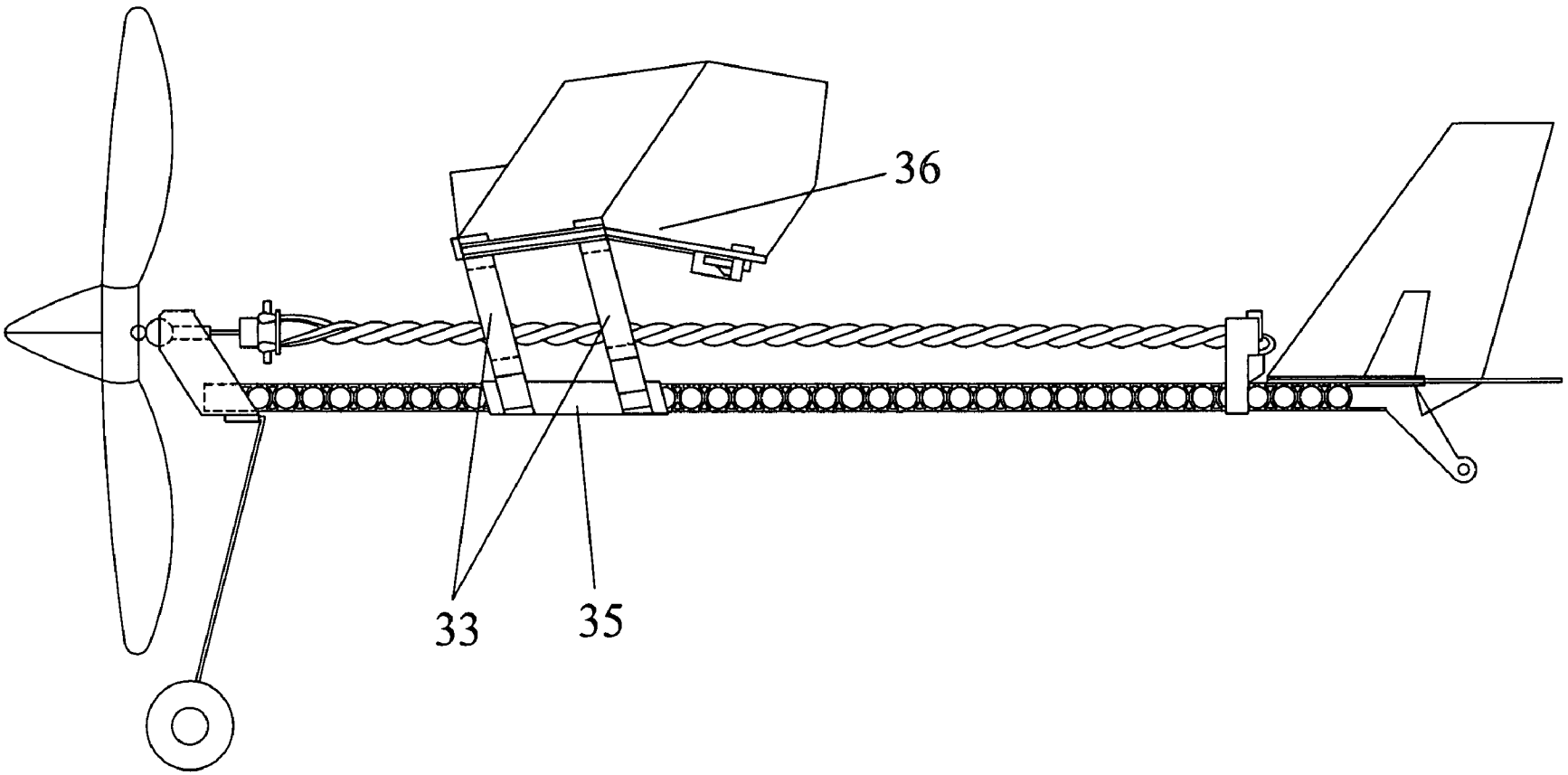
FIG. 7 is a schematic diagram illustrating a main wing brace applied to a monoplane according to an embodiment of the present invention.

FIG. 7 is an embodiment of the present invention applied to a monoplane. Please refer back to FIG. 5, the hollow double ring 31 is divided into two single hollow rings 33 along a central line of the rectangular brace member 32. The two single hollow rings 33 are assembled to two ends of the fuselage sleeve 35 so as to provide the monoplane as shown in the figure by combining with a main wing 36.

Figure 8:
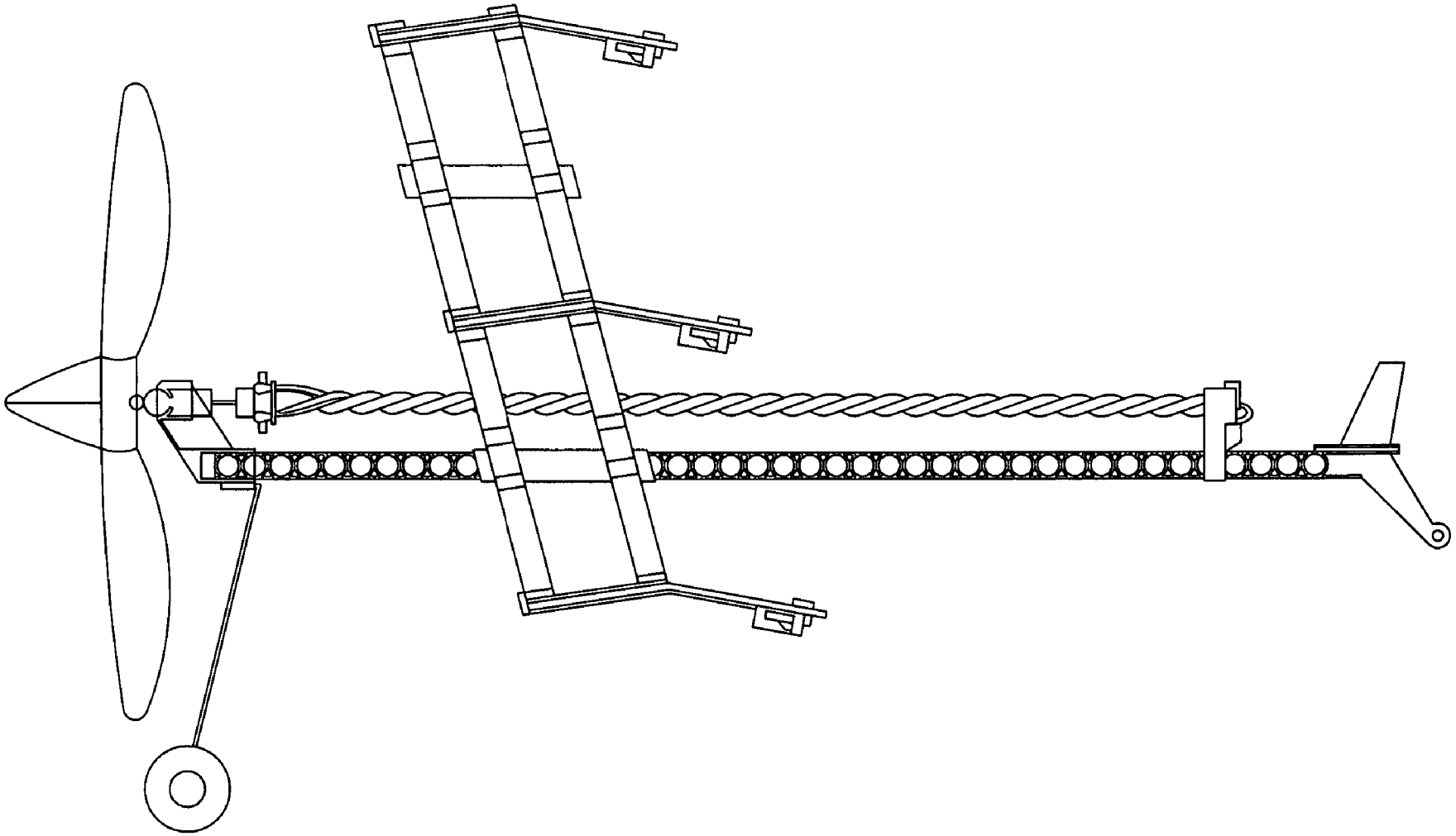
FIG. 8 is a schematic diagram illustrating a main wing brace applied to a triplane according to an embodiment of the present invention.

FIG. 8 is an embodiment of the present invention applied to a triplane. The main wing braces of the triplane are composed of four hollow double rings 31 and two fuselage sleeve 35. The three main wing braces can be separated into an upper level, a middle level and a lower level, wherein the main wing braces shown in FIG. 6 are overlapped and the overlapping portion shares the same main wing.

By the way mentioned above, the invention could improve flying quality of model aircrafts substantially, and is particularly in favor of mass production and diversification.

What is claimed is:

1. A stick fuselage of a model aircraft, the stick fuselage comprising a transverse H-beam as a main structure, an interval between two sides of the beam having continuously annular bodies as reinforcement structures; the H-beam being attached to an aircraft nose, the aircraft nose having a spherical pairing for adjusting the direction of a power shaft; and the H-beam being attached to a main wing brace rearward of the aircraft nose, the main wing brace employing a hollow double ring configuration for assembling two ends of a fuselage sleeve, and for mounting at least one aircraft wing.

2. The stick fuselage of the model aircraft of claim 1, wherein the cross-section of the stick fuselage of the model aircraft utilizes a transverse H-beam, and an interval between two sides of the transverse H-beam has the continuously annular bodies made by integrated molding for the reinforcement, and the continuously annular bodies are interlaced to enhance bending and twist resistances.

3. The stick fuselage of the model aircraft of claim 1, wherein the spherical pairing of the aircraft nose of the model aircraft is composed of a concave spherical surface and a spherical bearing to allow free adjustment of direction so as to provide the power shaft to define the orientation of the thrust line.

4. The stick fuselage of the model aircraft of claim 3, wherein the spherical pairing of the aircraft nose includes a half-spherical cavity disposed at the front of the aircraft nose and a through hole disposed to the bottom of the half-spherical cavity, and the spherical bearing is composed of a spherical tip and a tube tail passing through the through hole, so that the spherical bearing and the half-spherical cavity form a spherical pair, and the tube tail of the spherical bearing penetrates and is glued to the aircraft nose.

5. The stick fuselage of the model aircraft of claim 3, wherein the spherical pairing of the aircraft nose further includes a motor box disposed to the front of the aircraft nose to accommodate a motor, and the rear of the motor box has a half-spherical cavity that is formed a spherical pairing together with a half-spherical convex disposed to the front of a fuselage joint.

6. The stick fuselage of the model aircraft of claim 1, wherein the main wing brace of the model aircraft includes two single hollow rings connected with each other through a rectangular brace member to form a hollow double ring, and two hollow double rings then are employed, and the rectangular brace members connected to the two hollow double rings are assembled to two ends of a fuselage sleeve with tube-shaped respectively to form the main wing brace, and upper and lower ends of the two hollow double rings have notches for assembling upper and lower main wings, thereby providing a biplane.

7. The stick fuselage of the model aircraft of claim 6, wherein the main wing brace further comprises that the hollow double ring is divided into two single hollow rings along a central line of the rectangular brace member, the two single hollow rings are assembled to two ends of the fuselage sleeve to form the main wing brace, and notches of the two single hollow rings are used to secure a main wing, thereby providing a monoplane.

8. The stick fuselage of the model aircraft of claim 6, wherein the main wing brace further comprises that four hollow double rings are connected with each other in pairs, and the rectangular brace members connected to the four hollow double rings are assembled to two ends of two fuselage sleeves respectively to form a triple main wing brace, and the four hollow double rings have notches for assembling three main wings, thereby providing a triplane.

9. The stick fuselage of the model aircraft of claim 6, wherein the single hollow ring and the hollow double ring of the main wing brace is a hollow annular ring, a hollow ellipse, a hollow square ring or a hollow polygon.

* * * * *